US006105290A

United States Patent [19]

Coates et al.

[11] Patent Number: 6,105,290

[45] Date of Patent: Aug. 22, 2000

[54] DISPLAY DEVICE

[75] Inventors: Alan Bernard Coates, Bondi Beach; James Lee Conlon, Rose Bay, both of Australia

[73] Assignee: Coates Signco Pty. Limited, Waterloo, Australia

[21] Appl. No.: 09/211,933

[22] Filed: Dec. 15, 1998

Related U.S. Application Data

[63] Continuation-in-part of application No. 08/809,898, Nov. 22, 1995, abandoned.

[30] Foreign Application Priority Data

| | | | |
|---|---|---|---|
| May 25, 1993 | [AU] | Australia | PL9006 |
| Aug. 11, 1993 | [AU] | Australia | PM0507 |
| Mar. 7, 1994 | [AU] | Australia | PM4293 |
| Jun. 12, 1998 | [AU] | Australia | PP4092 |

[51] Int. Cl.[7] ..... G09F 11/18

[52] U.S. Cl. ..... 40/518; 40/471; 40/524

[58] Field of Search ..... 40/471, 518, 524, 40/5; 198/502.1, 837

[56] References Cited

U.S. PATENT DOCUMENTS

| | | | |
|---|---|---|---|
| 3,426,461 | 2/1969 | Miller | 40/471 |
| 4,682,430 | 7/1987 | Ramsay | 40/5 |
| 5,111,927 | 5/1992 | Schulze, Jr. | 194/209 |

FOREIGN PATENT DOCUMENTS

| | | | |
|---|---|---|---|
| 0791904 | 8/1997 | European Pat. Off. . | |
| 3725788 | 3/1988 | Germany | 40/518 |
| WO 92/07348 | 4/1992 | WIPO . | |
| WO 94/20945 | 9/1994 | WIPO . | |

*Primary Examiner*—Joanne Silbermann
*Attorney, Agent, or Firm*—Darby & Darby

[57] ABSTRACT

A display device (30), particularly for use as a menu board in a restaurant or the like. The device (30) has at least two rotatable roller members (31 or 32) located in substantially parallel spaced apart relationship. Carrier means (38) is provided, tightly supported by and rotatable about the rollers (31 and 32) and adapted to receive at least one display means (36) thereon. Each of the carrier means (38) and said display means (36) are constructed at least partially of substantially flexible and translucent material. Illumination means (37) are provided behind at least a portion of said carrier means (38), to illuminate a viewing portion of said carrier means (38) and said display means (36) thereon. Preferably, each display means each display means (36) is sized and shaped to fit between a pair of adjacent rollers such that one or more discrete rest position(s) is/are automatically identified after said display device (30) is rotated, whereby, in said rest position(s), one of said display means (36) is centrally positioned between a respective pair of rollers (31 or 32). Alternatively, but also preferably, the carrier may be designed to be of different thicknesses, such as by providing a cutout. Alternatively still, alignment tabs may be provided. A tensioning device is also preferably provided to ensure that optimum tension is provided to the carrier during use. This is configured in such a manner that assembly/disassembly of the device is readily facilitated.

22 Claims, 14 Drawing Sheets

DISPLAY DEVICE

This application is a continuation-in-part of patent Application No. 08/809,898, now abandoned which is incorporated herein by reference.

TECHNICAL FIELD

The present invention relates to a display device, and in particular, to a rotating display device, particularly suitable for, but not limited to, a rotating menu board for use in a fast food restaurant.

BACKGROUND OF THE INVENTION

Menu boards used in fast food outlets are typically positioned at more than two meters above ground level, usually behind and/or above the serving counter, or, in a driveway—for a drive-through service. The difficulty encountered with utilising such menu boards is that they are difficult and cumbersome to change, due to their size and position.

Also, in some fast food outlets, two or more menus are often utilised throughout the day, for instance, at breakfast or at lunch and/or dinner. With such prior art menu boards, fast food outlets with two or more menus typically show both their menus throughout the entire day. This causes delays, confusion and misordering by customers, when looking at the wrong menu.

Various rotating menuboards have herebefore been designed, to overcome these problems, such as described in Australian Patent No. 640211 by Florida Plastics Midwest, Inc. AU 640211 describes a rotatable display sign which has a circular-like member 56 (FIG. 7) with a plurality of recessed portions around the circumference thereof. A plurality of rigid panel portions 34 which are interconnected on their longitudinal edges by hinge-like means. The hinge-like means 40,41 engage the recessed portions 58 such that, when a handle 62 is manually operated, the drum like member 56, via a gearing arrangement 55, facilitates movement of the display sign panels 34.

As will be appreciated, the device of AU 640211 is quite difficult to manufacture due to its vast number of components, is cumbersome to operate due to the necessity to turn handle 62—which may typically be positioned some two meters above ground level, and is prone to breakage—due to its complex design and incorporation of many moving parts.

SUMMARY OF THE INVENTION

The present invention seeks to provide a display device which overcomes the disadvantages of the prior art.

The present invention also seeks to provide a display device which enables the alternative positioning of a display means between, a viewing position, and one or more storage position(s), such that, different displays can be provided at different predetermined times throughout the day, etc.

The present invention seeks to provide a display device which provides 'tension' to the carrier such that it is tightly retained about the rollers.

The present invention also seeks to provide a display device in which the 'carrier' may be quickly and easily removed/installed.

In one broad form, the present invention provides a display device, including:

at least two rotatable roller members located in substantially parallel spaced apart relationship;

a carrier means, embodied as a belt, band or the like, and, formed of a lightweight polycarbonate or like plastics material, such as 'LEXAN' (Trade Mark), being tightly supported by and rotatable about said rollers and/or onto at least two of said roller members, in a spool-like manner, and adapted to receive at least one display means thereon, each of said carrier means and said display means being constructed at least partially of substantially flexible and translucent material;

each display means embodied as translite(s) (as herein defined) and/or slat(s) being sized and shaped to fit between a pair of adjacent rollers such that one or more discrete rest position(s) is/are automatically identified after said display device is rotated, whereby, in said rest position(s), one of said display means is centrally positioned between a respective pair of rollers; and, illumination means, provided behind at least a portion of said carrier means, to illuminate a viewing portion of said carrier means and said display means thereon.

Preferably, said display device is biased into its discrete rest position(s) due to alteration in thickness of the belt formed by the carrier and the translite(s) and/or slats(s).

Also preferably, due to the greater thickness of the belt in the regions whereat the translites are affixed, the carrier identifies at least one rest position, where the translite(s) are displayed in the regions intermediate the rollers.

Also preferably, due to the provision of at least one cutout from the belt, the portion of the belt with a cutout finds a rest position about the roller surface.

Also preferably, at least one alignment tab is provided on the rear surface of the carrier to identify a rest position of the carrier about the rollers.

In a preferred form said translite(s) is/are attached to said carrier by a substantially transparent/translucent adhesive material.

In an alternatively preferred form of the invention said translite(s) is/are attached to said carrier by a covering sheet provided over substantially the entirety of said carrier, such that each translite is positioned between said carrier and said covering sheet.

In an alternatively preferred form said translite(s) is/are attached to said carrier by a hook and loop fastening system, such as Velcro.

Preferably, each said slat(s) is attached to said carrier by slat carrier means.

Preferably, each said slat carrier means has a lip thereon to support an edge of a respective slat.

Preferably, each slat may optionally be provided with at least one window portion therein, and wherein an indicia module may be provided behind said window.

In a preferred form each indicia module comprises:

at least one substantially translucent carrier to removably house an indicia card;

at least one attachment means to attach said indicia module to said slat carrier means.

Preferably, said attachment means comprises at least one protrusion on the edge of each module, adapted to be retained by said slat carrier means.

In a preferred embodiment the display device further comprises drive means, to drive at least one of said roller members and to thereby selectively move at least one display means between a viewing position and a storage position(s).

In one version, said drive means continuously moves said carrier means.

In a further broad form, the present invention provides an alternative version said drive means is operated intermittently, to move one of at least two display means to said viewing position, one at a time.

Preferably, the indicia module for use with a display device having slat carriers or the like, includes:

a module frame, sized and shaped to fit between a pair of slat carriers; and display window means intermediate said module frame, for selectively and removably inserting display indicia therein;

characterised in that said module is provided with at least one protrusion forming an attachment means such that resistance to sliding of said module along said slat carrier is effected.

Also preferably, the present invention provides a display device, including at least two rotatable rollers located in a substantially parallel spaced-apart relationship and adapted to receive a carrier thereabouts, characterised in that at least one end of at least one of the rollers is supported on an axle which, in its assembled position, is biased to retain said carrier under tension.

Preferably, said at least one end of at least one of the rollers is biased by means of a spring.

Also preferably, at least one of the rollers is supported by an axle in which at least one end thereof may be displaced between first and second positions, whereby in a first position said display device is ready for use, and, in a second position, said axle is displayed more proximal relative to the other roller(s) such that the carrier may be removed/installed from said rollers.

Preferably, the displacement of said axle is achieved by movement of said axle within a slot which is substantially J-shaped or inverted J-shaped.

Preferably, at least one side plate supporting said rollers is formed such that, at least in said second position, said carrier may be slid over said side plate.

Also preferably, to facilitate removal/installation of said carrier from/onto said rollers, said at least one side plate is formed of removable and/or pivotal sections.

BRIEF DESCRIPTION OF THE DRAWINGS

The present invention will become more fully understood from the following detailed description of the preferred but non-limiting embodiment described in connection with the accompanying drawing, wherein.

DETAILED DESCRIPTION OF THE PREFERRED EMBODIMENTS

Figure 1A:
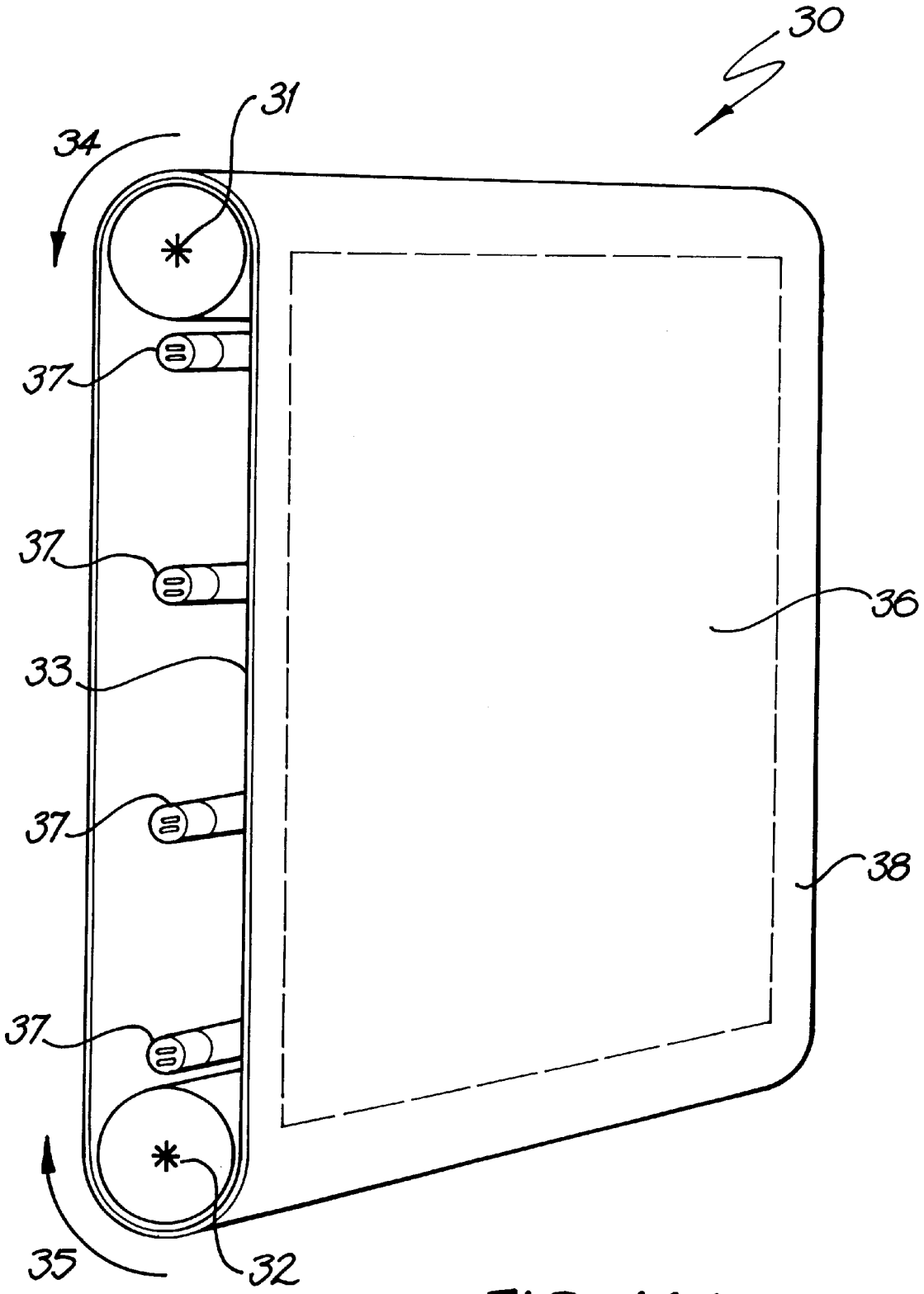
FIG. 1 shows, in FIG. 1(*a*) a schematic perspective view of a preferred embodiment of the display device of the present invention, and, in FIG. 1(*b*), a preferred embodiment of such a display device within a housing.
Figure 1B:
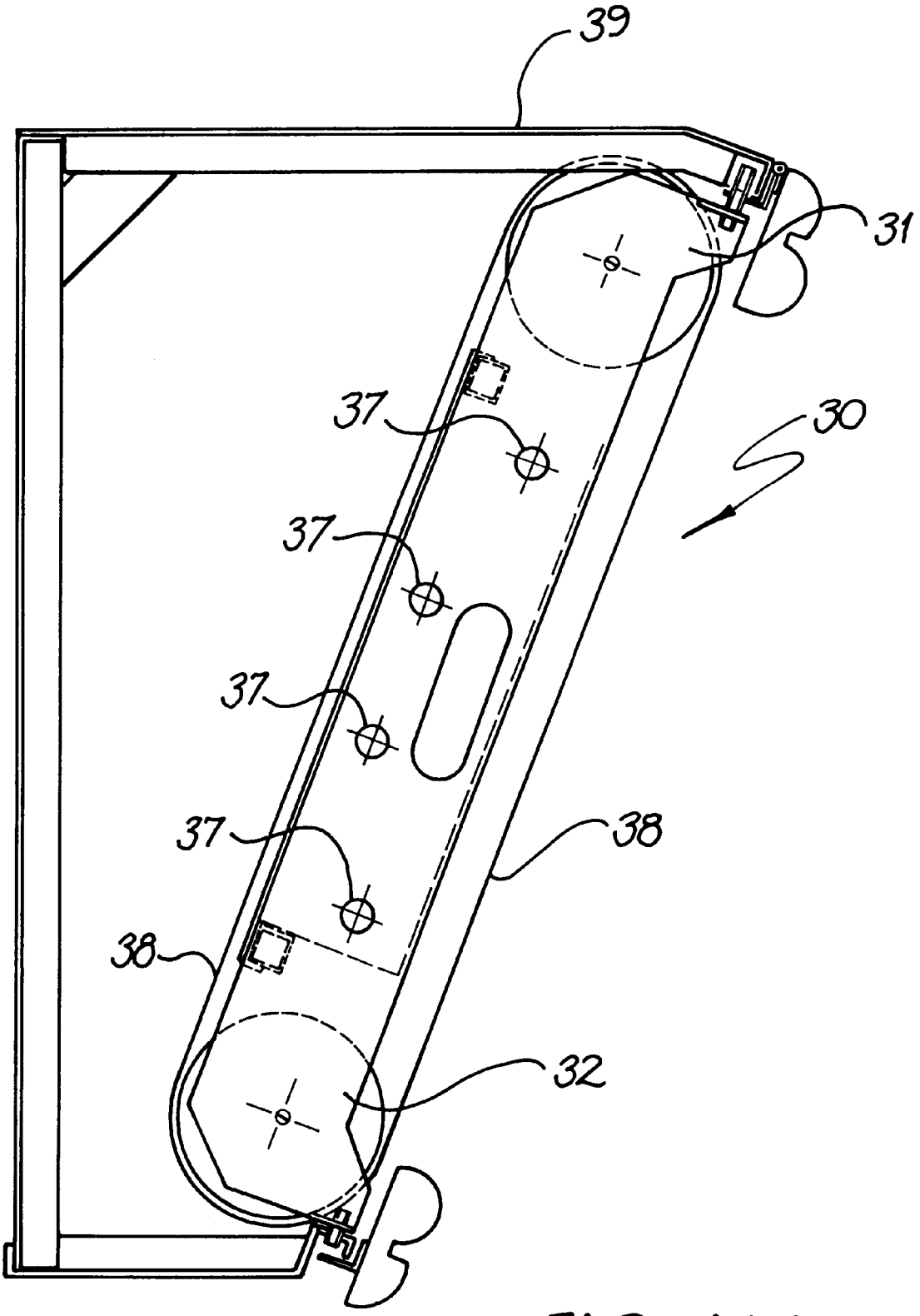
Figure 2A:
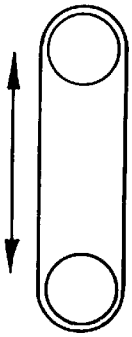
FIG. 2 shows, in FIGS. 2(*a*) to 2(*f*) thereof, various schematic views of alternative roller arrangements useful for the invention.
Figure 2B:
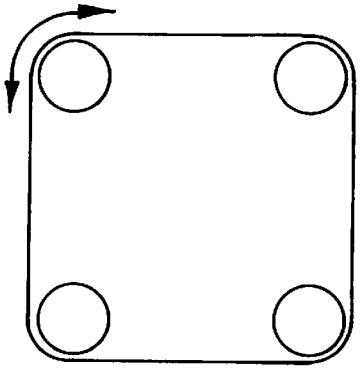
Figure 2C:
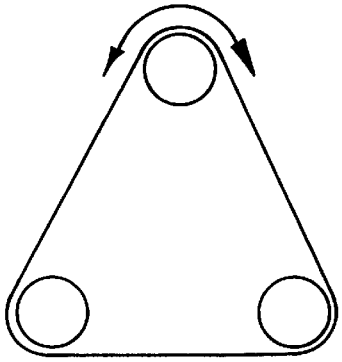
Figure 2D:
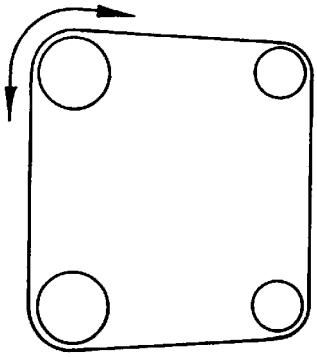
Figure 2E:
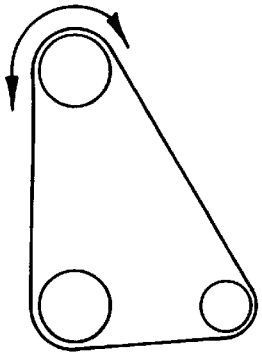
Figure 2F:
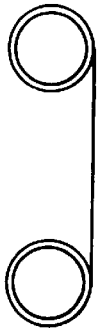
Figure 3A:
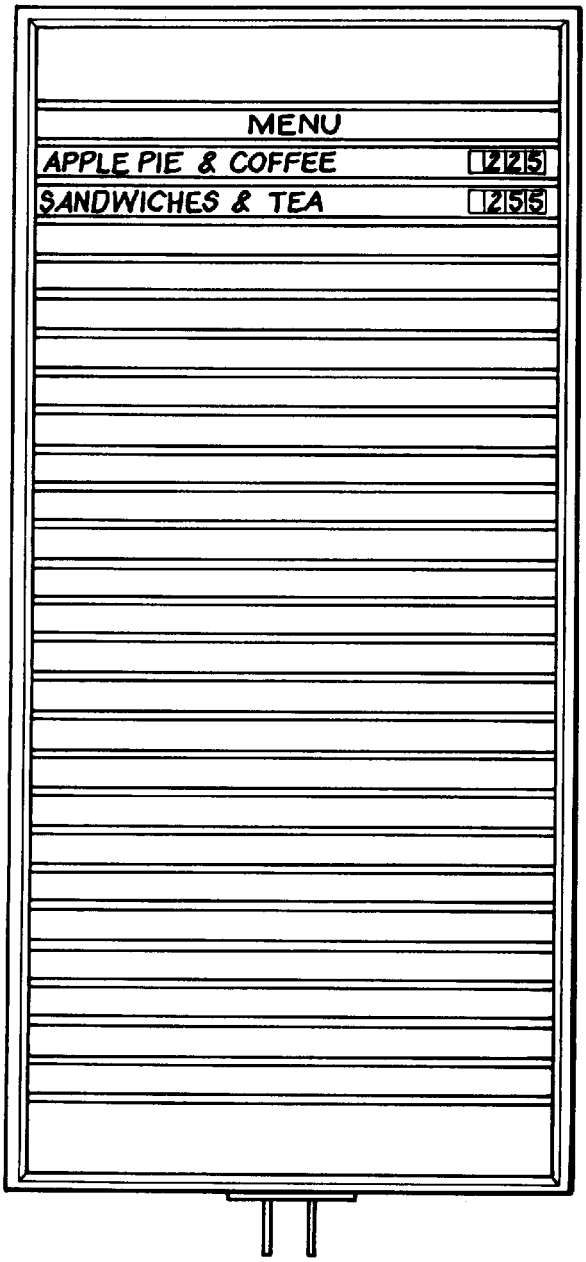
FIG. 3 shows, in FIGS. 3(*a*) to 3(*d*) thereof, various details of a preferred embodiment of the invention wherein a plurality of slats, held by a suitable slat carrier means, form the display device.
Figure 3B:
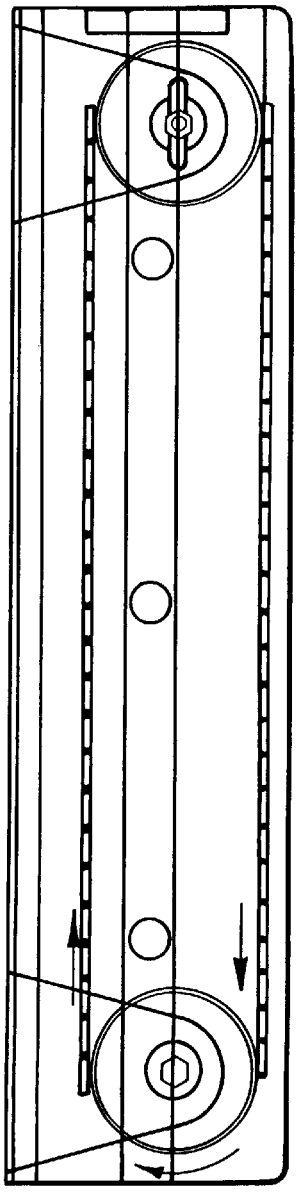
Figure 3C:
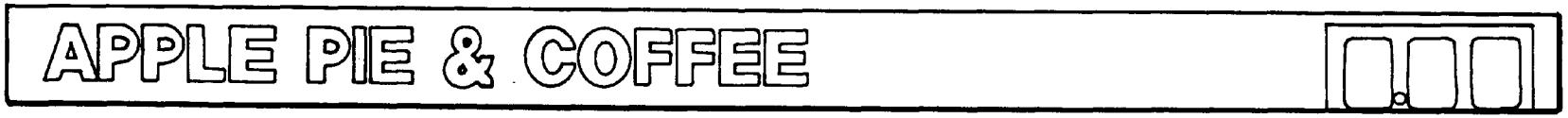
Figure 3D:
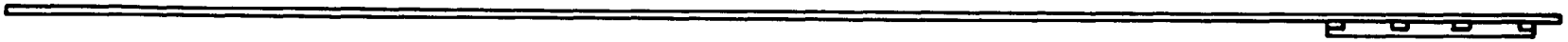

As shown in FIG. 1, a display device 30 comprises a pair of rotatable roller members 31 and 32 located in parallel spaced apart relationship. A carrier means 33 is mounted between the roller members 31 and 32, in a belt like manner. It may either rotate in the direction of arrow 34, the direction of arrow 35, or, in both directions 34 and 35, one at a time. Rotation of the carrier may be effected either manually, or by drive means, which is not shown in the drawings. The drive means may either drive one or both of the roller members 31 and 32 to thereby selectively move the carrier means 33. The carrier means 33 is adapted to receive at least one display means 36 in a removable manner thereon. Preferably, the embodiment depicted in the drawing will be provided with at least two display means 36 thereon, one on the "front" of the display device 30, and one on the rear of the display device 30. By operation of the drive means, the display means 36 may be selectively moved between a viewing position and a storage position. That is, the viewing position will be at the front of the display device, and the storage position will be at the rear of the display device.

Lights or other illumination means 37 are provided between the roller members 31 and 32 to illuminate the display means 36 when in the viewing position. This is achieved by constructing the carrier means 33 and the display means 36 at least partly of transparent and/or translucent material or the like, such that the light can shine therethrough.

As shown in FIG. 1(*b*), the display device 30 may be provided in a housing 39—the housing 39 being intended to be provided in an overhead position behind a serving counter in a restaurant, bar, shop or the like. It will be appreciated that, by installing the device 30 in such a housing 39, the device 30 faces a person in front of the counter.

As hereinbefore mentioned, the display means is removably attached to the carrier means by any known means, for example, by a substantially transparent or translucent adhesive material such as used for window stickers, etc, or by other known means which permits easy placement and removal such as VELCRO, sticky tapes, or the like. The display device may either be used to alternatively, intermittently or continuously, display two or more display means 36, by intermittently or continuously rotating the rollers 31 or 32, or, by an electric/electronic drive means, to move one of at least two display means to a viewing position, one at a time. This may, for example, be useful for displaying at least two menus, one at a time, in a fast food restaurant, whereby one menu is to be displayed during breakfast, and another menu is to be displayed during lunch or dinner at predetermined times. For example, the menus could be changed at 10:00 am when it is desired to cease displaying the breakfast menu and thereafter display the lunch menu. The display device may be operated such that the drive means causes the breakfast menu to be moved from the front to the rear of the display device such that the lunch menu is thereafter displayed.

Suitable control circuitry may be provided to automatically affect this operation, or, the drive means may be manual, or be operated by a switch, electrical component/circuitry or the like.

One of the features that makes the display device of the present invention different from the display devices of the prior art, is the material of which the display device belt 38 is fabricated. This belt, or carrier means, is, in accordance with the present invention, constructed of a substantially flexible and translucent material. That is, the carrier means or belt is preferably constructed of a plastics or other polycarbonate material such as "LEXAN" (Trade Mark). This allows the belt to stretch between the pair of rollers 31 and 32 and rotate thereabout. The use of such a material allows easy hand movement of the display device, unlike the prior art device, such as shown in Australian Patent 640211, which requires a cumbersome operation of a handle. The use of such a polycarbonate material such as LEXAN also has translucent characteristics allowing the illumination means 37 to shine therethrough. An extremely useful characteristic feature of using such a tightly provided but lightweight belt about the rollers, is that "self-alignment" is achieved, as will be described in more detail hereinafter.

As mentioned hereinbefore, either a single "translite" 36 or a plurality of slat like members may be positioned in the outline shown by reference numeral 36. The term "translite" is a term known to persons skilled in the art and is used to refer to a substrate or transparency which may have an image printed thereon or formed otherwise thereon by digital imaging. The image may be any combination of words, logos, pictures, etc. As such, when the term "translite" is used throughout this specification, it should be considered to be defined to encompass such meaning. It will be appreciated that a further "translite" or set of slat like members would also be provided on the back surface of the belt 38. Obviously, when in use as a display sign, there is no sign attached to the curve portions or end portions of the overall device, i.e. the portion about the rollers 31 and 32. Consequently, a unique effect of the invention results. That is, due to natural balancing effects, automatic alignment of the display portions occurs to 'rest positions', such that a display is either provided on the front or back surface, but does not tend to stop halfway between the front and back and about the rollers 31 or 32. This is facilitated by the combination of lightweight materials for the belt and a smooth rolling action of the rollers 31 and 32.

As mentioned hereinbefore, a single transparency can be supplied on to each of the front and back surfaces of the belt 38, such as within the dotted lines shown by reference numeral 36 in FIG. 1. A variety of means can be utilised for attaching a single transparency, such as glues, VELCRO, tapes, etc.

Alternatively, a plurality of slat holders may be supplied on to the belt, such that slats may be easily inserted therein.

Such a slat arrangement in shown in FIG. 3, FIG. 3(*a*) illustrating a front view thereof, and FIG. 3(*b*) illustrating an elevational view thereof. Details of a particular slat is illustrated in front view and elevational view in FIGS. 3(*c*) and 3(*d*). The slats slide into the slat carriers, as will be understood, behind a lip provided along each edge of the carriers.

Figure 4A:
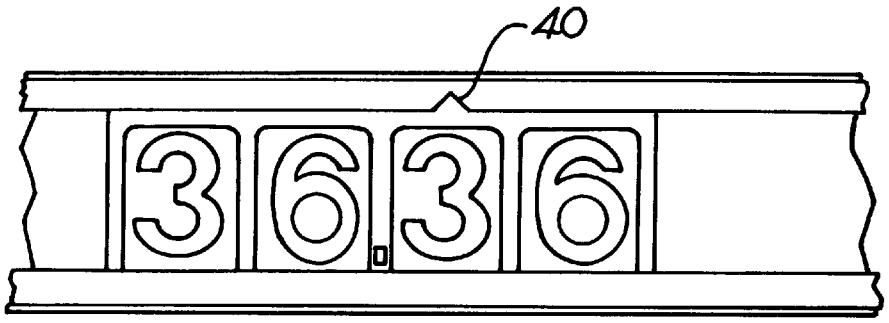
FIG. 4 details in FIGS. 4(*a*) to 4(*c*) thereof an indicia display capsule utilised with the embodiment of FIG. 3.
Figure 4B:
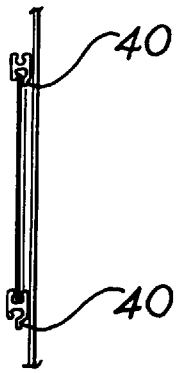
Figure 4C:
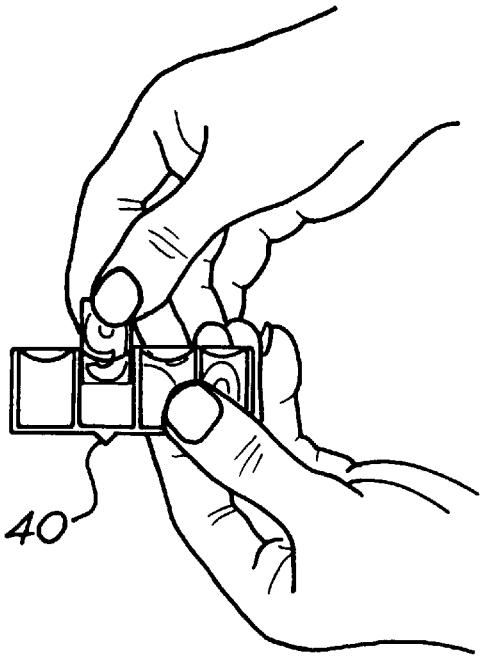

In FIG. 4 is shown an indicia display capsule, useful for use with the slat arrangement of FIGS. 3. Front and elevational views are shown in FIGS. 4(*a*) and 4(*b*). By this unique design of the indicia display capsule, indicia may be easily inserted into the capsule as shown in FIG. 4*c*, and then, due to the provision of unique protruding portions 40, the capsule may be easily inserted into position and held therein between pairs of slats. Consequential sliding in or out of the slats over the capsule does not result in movement of the capsule. Such a module may be useful in display devices other than that shown in the drawings.

It will be appreciated by persons skilled in the art that numerous variations and modifications will become apparent.

For example, as it will be appreciated by persons skilled in the art, depending on the number of display message required, variations to the device, with differing numbers of rollers, can be made. Examples of such variations are shown in FIG. 2. FIG. 2 shows the use of a plurality of single size rollers in FIGS. 2(*a*), 2(*b*) and 2(*c*), the use of smaller diameter rollers—in FIGS. 2(*d*) and 2(*e*)—which enable a 'longer' viewing area on the front of the display device, and, the use of rollers wherein the carrier may roll onto the rollers—in FIG. 2(*f*). Such an embodiment of FIG. 2(*f*) may be particularly useful where space constraints are defined.

It will be appreciated by persons skilled in the art that one of the unique advantages of the present invention is the unique ability for the carrier (with translites) to be easily manually rotated and to be able to automatically identify its rest position wherein the translite is centrally aligned between the pairs of rollers. As hereinbefore mentioned, this is achieved by the embodiment hereinbefore described due to the natural balancing effects of the 'translites' between the rollers. This is due to the translite and carrier being of greater thickness than the thickness of the carrier alone (i.e. in the portions where no translite is provided).

Figure 5A:
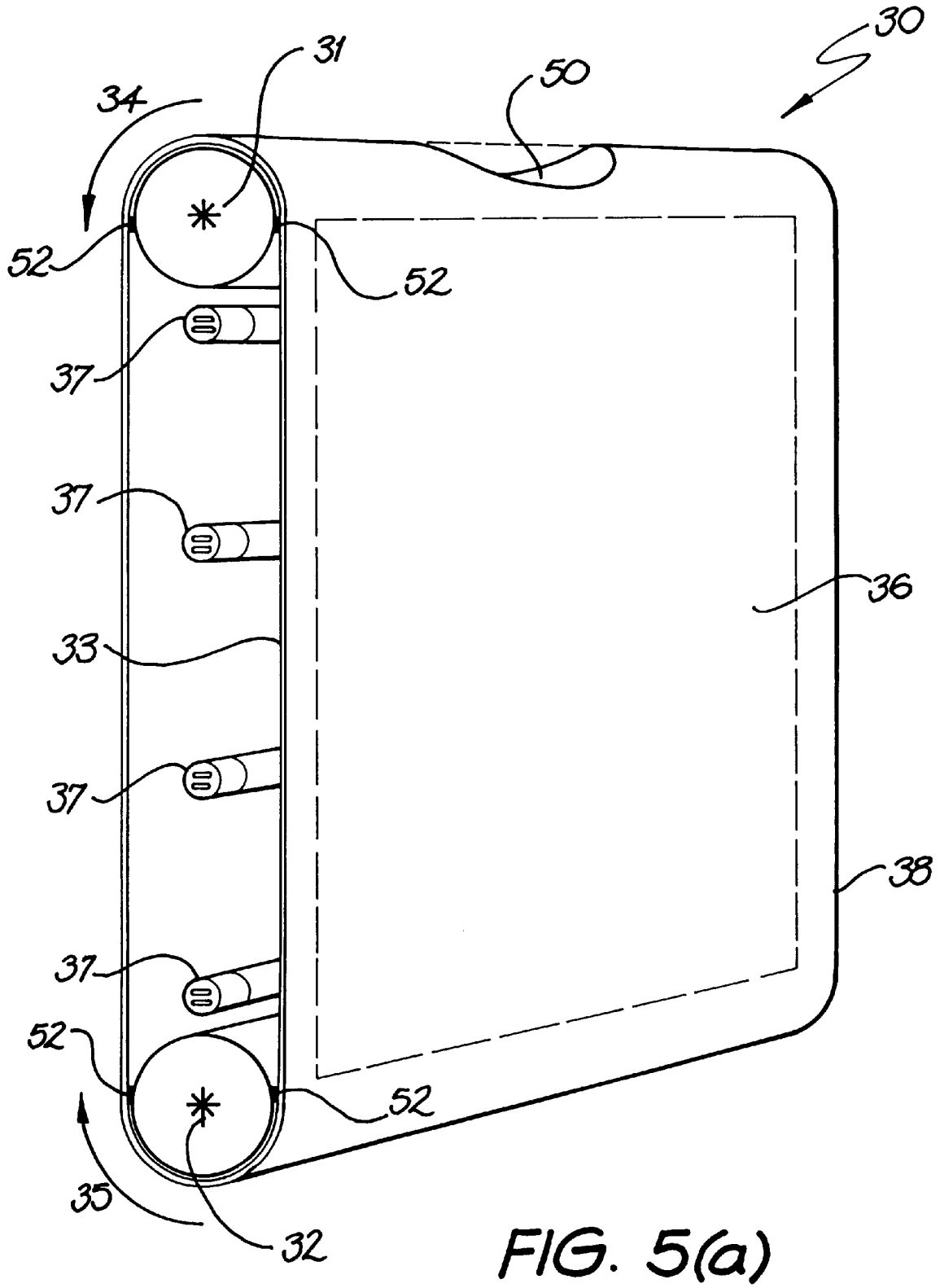
FIGS. 5(*a*) and 5(*b*), sometimes referred to collectively as FIG. 5 show details of a cutout on an arrangement of alignment 'tabs' which may be utilised separately, or in combination, in alternatively preferred arrangements of the present invention; and, FIG. 6 details in FIGS. 6(*a*) to 6(*c*), left elevational, plan and right elevational views, respectively, of the device in accordance with the present invention.
Figure 5B:
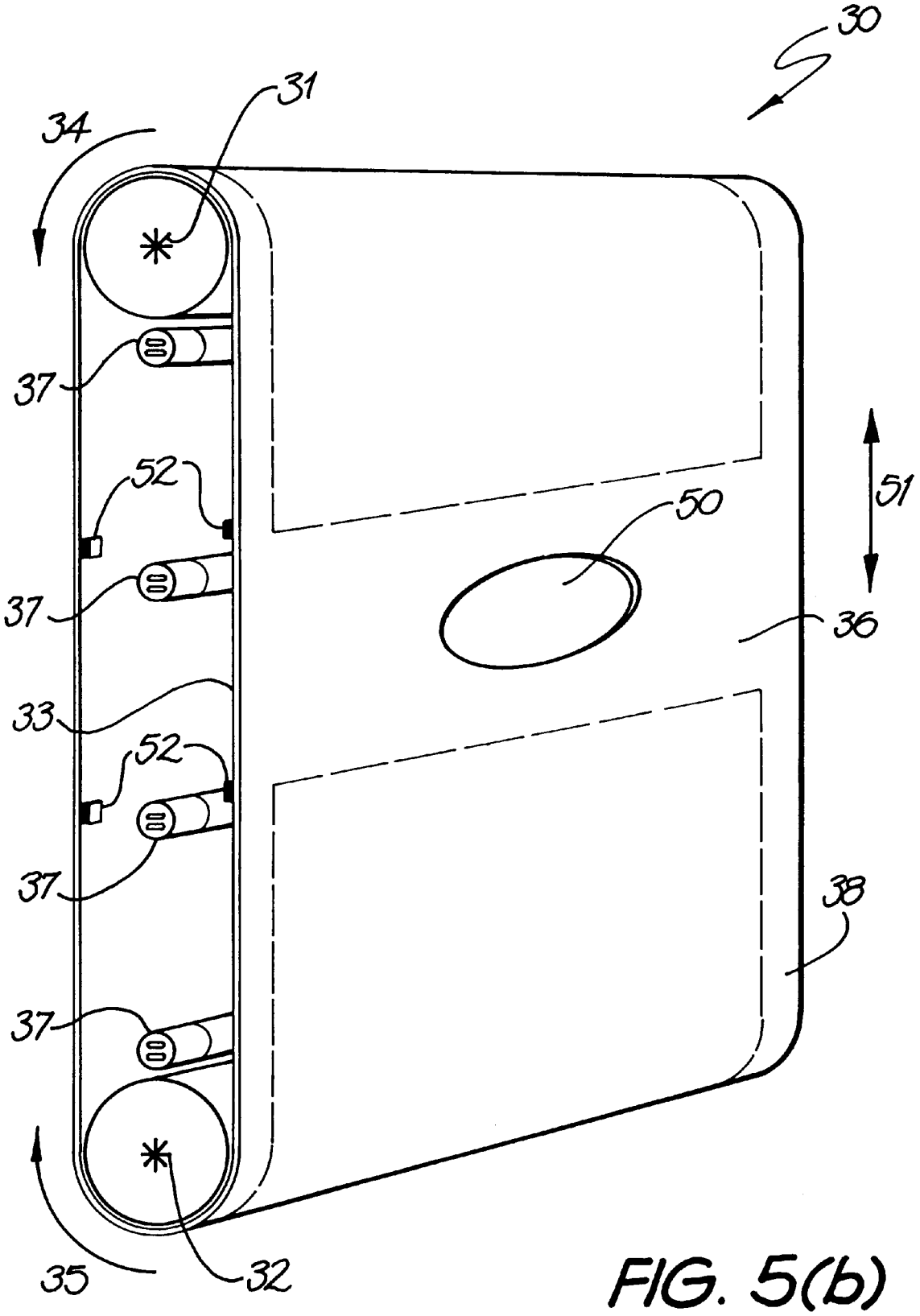

An alternative way of achieving a similar effect, or to increase this effect, is to reduce the amount of material in a certain portion of the carrier, such as illustrated in FIGS. 5(*a*) and 5(*b*). FIG. 5(*a*) illustrates a rest position of the device wherein a cutout 50 is provided in a portion of the carrier 33, whilst FIG. 5(*b*) illustrates an intermediate portion wherein the cutout 50 is displaced from the rollers 31 and 32, in which position the carrier thence becomes biased towards one or other end of the device in one of the directions indicated by arrow 51.

Yet another alternative way of achieving a similar effect, or to still further increase this effect, is to provide alignment 'tabs' onto the rearside of the carrier 33, such that movement of the carrier 33 about the rollers 31 and 32 is at least partially inhibited. Such alignment tabs are illustrated in FIGS. 5(*a*) and 5(*b*), and indicated by reference numeral 52. The alignment tabs may be provided at the edge portions of the carrier 33 only, or, may extend across the rear of the carrier 33. It will be understood that the size and shape of the alignment tabs may be varied to provide varying resistance or damping rotation of the carrier. The tabs may be formed of any suitable material and be attached by any suitable adhesive or the like.

It will be appreciated that the mere provision of the translites (providing the increased thickness to the carrier), the cutouts 50, and or the alignment tabs 52 may be provided separately, or in any combination thereof, to achieve the objects of the invention. Provision of all three features will provide the greatest degree of damping/alignment.

A further feature of the Applicant's invention is the provision of means for ensuring that the carrier 33 remains tensioned as it rotates about the rollers 31 and 32. The Applicant has also devised means by which the carrier 33 may be easily installed and removed from about the rollers 31 and 32, without leaving the rollers 'hanging' in a manner liable to be easily damaged.

Figure 6A:
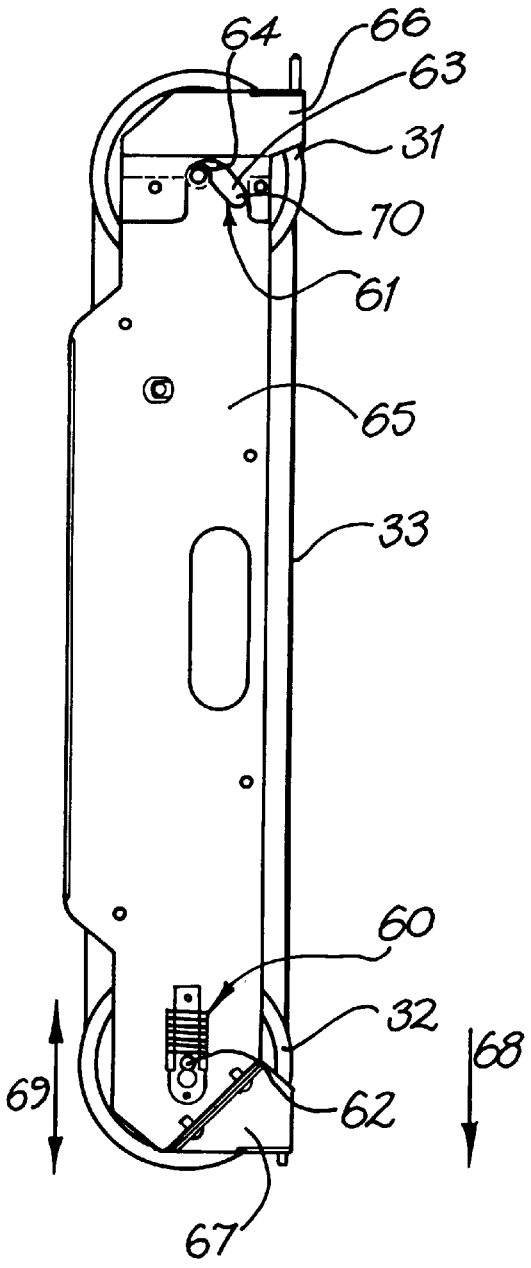
Figure 6C:
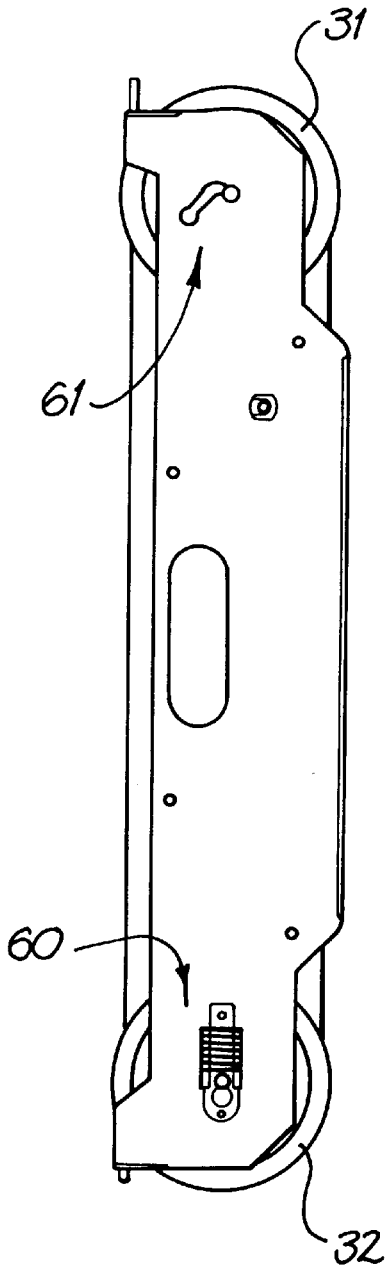
Figure 6B:
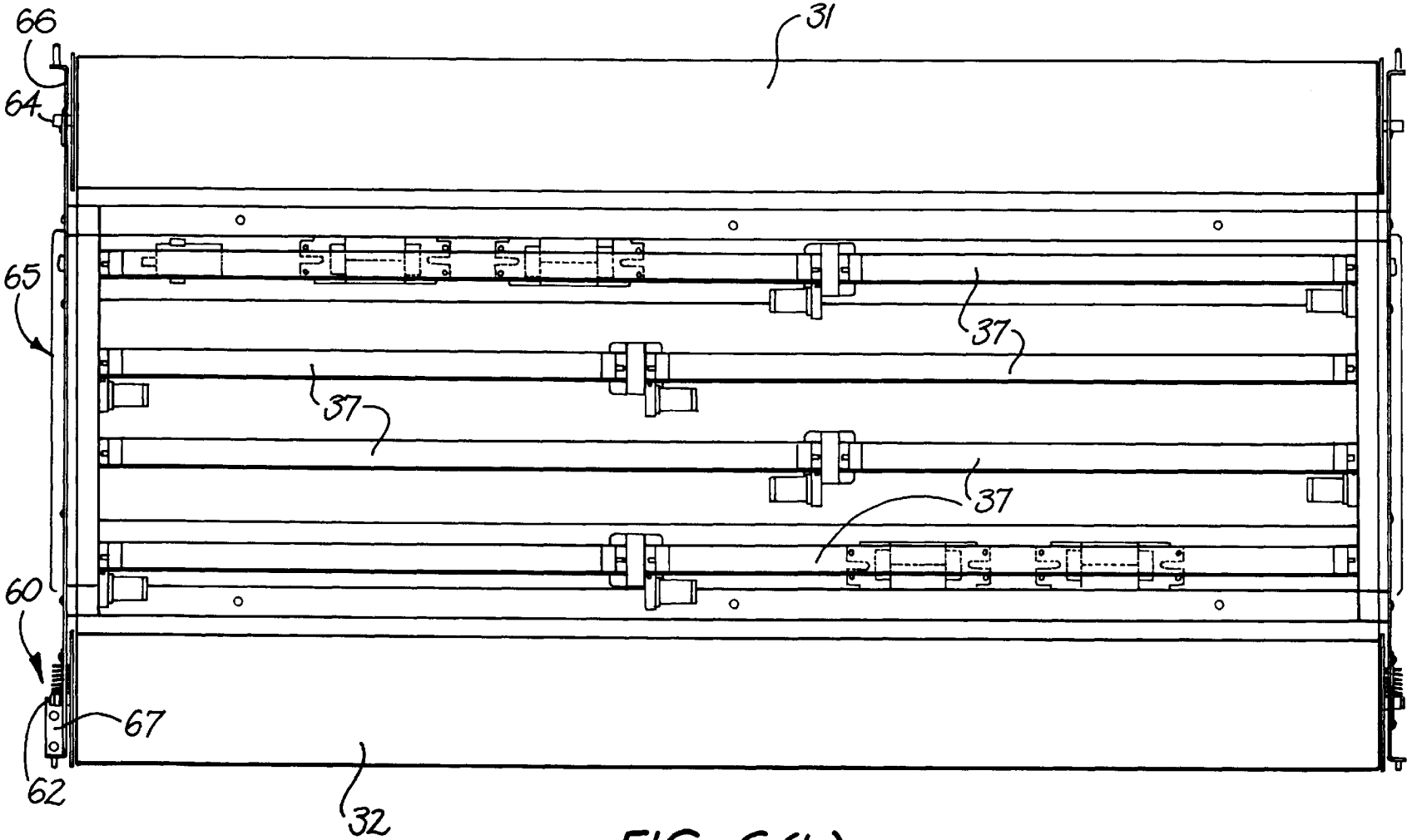
Figure 7A:
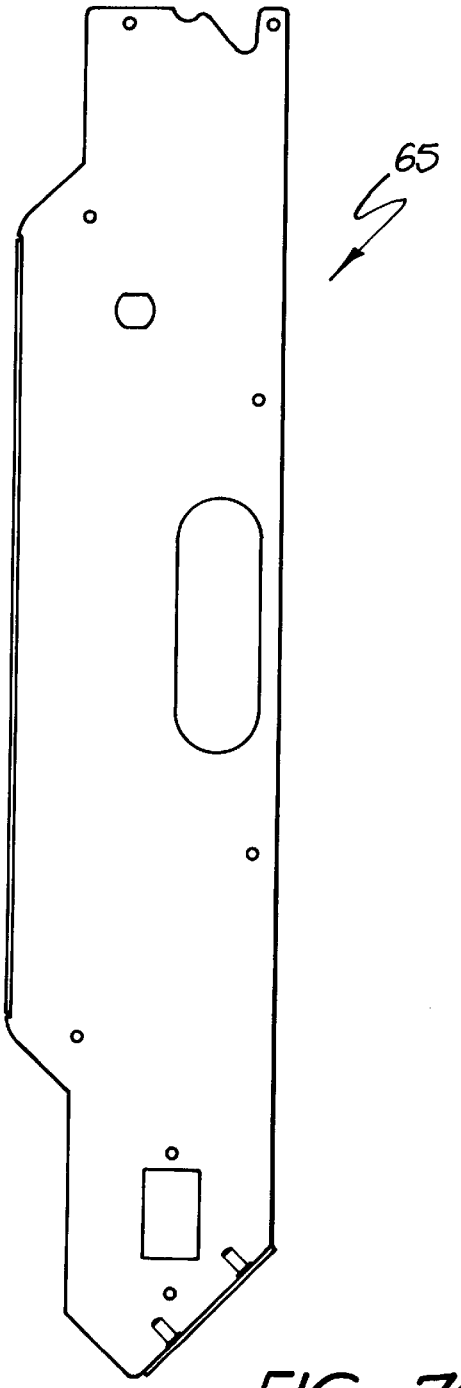
FIG. 7 illustrates details of the side plate and components therefor, including the main side plate shown in FIG. 7(*a*), the upper and lower end plates shown in FIGS. 7(*b*) and 7(*c*), respectively, and, the spring plate and spring assembly in FIGS. 7(*d*) and 7(*e*), respectively.
Figure 7C:
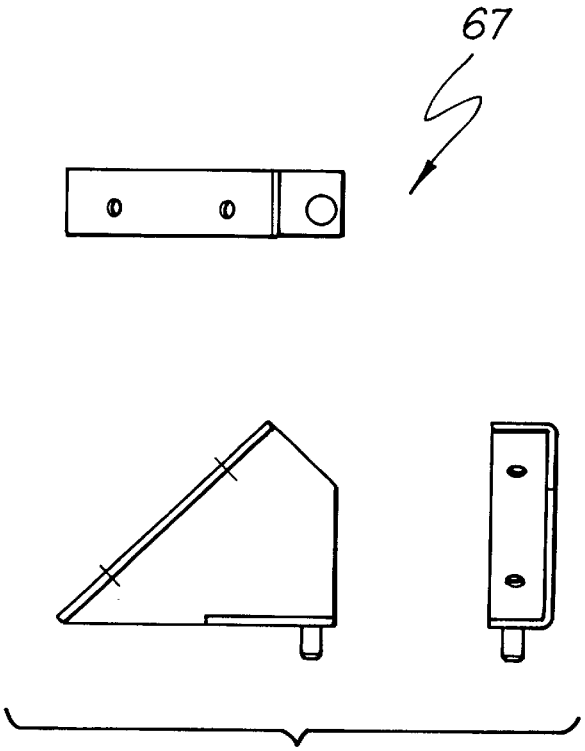
Figure 7B:
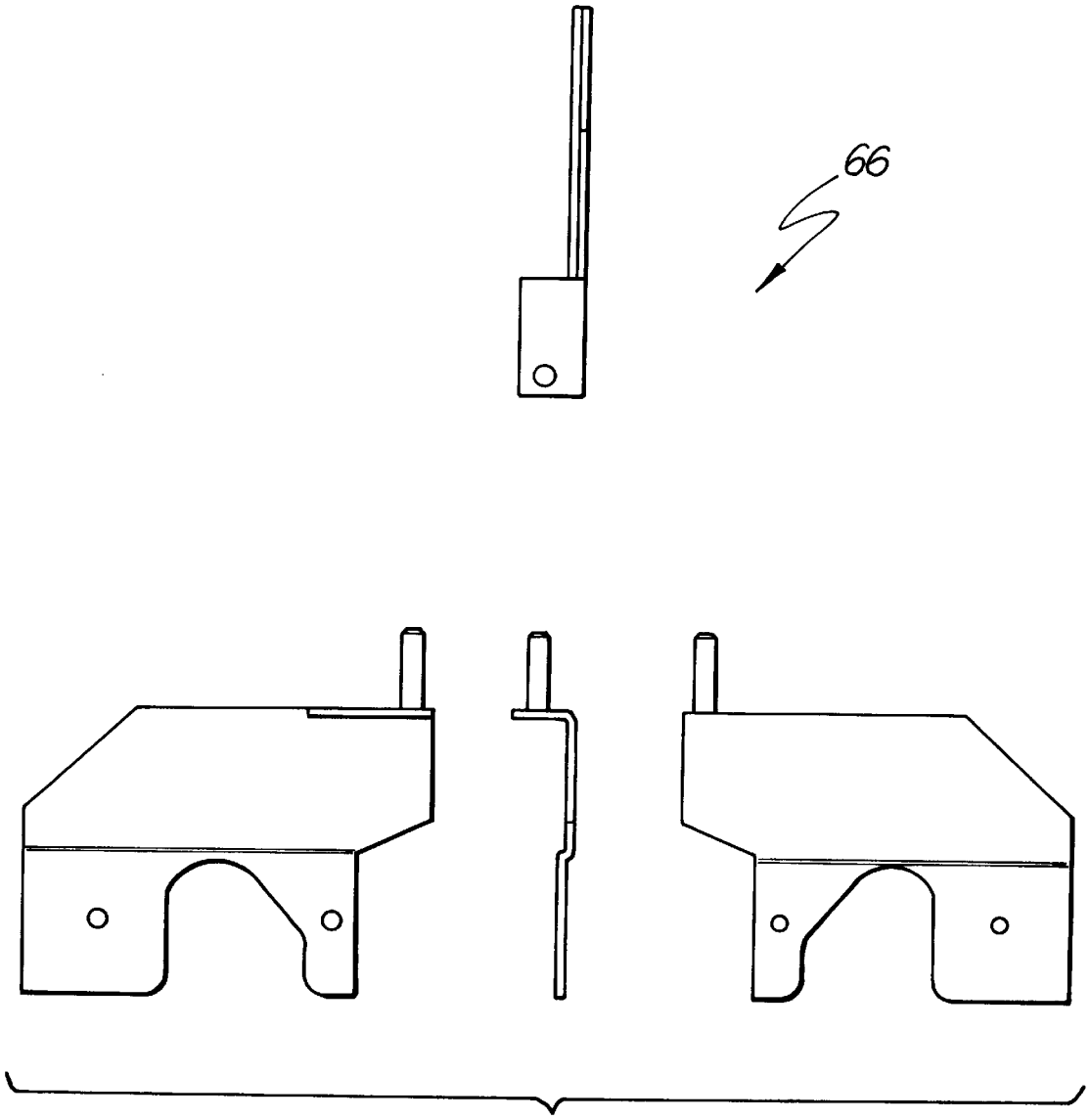
Figure 7D:
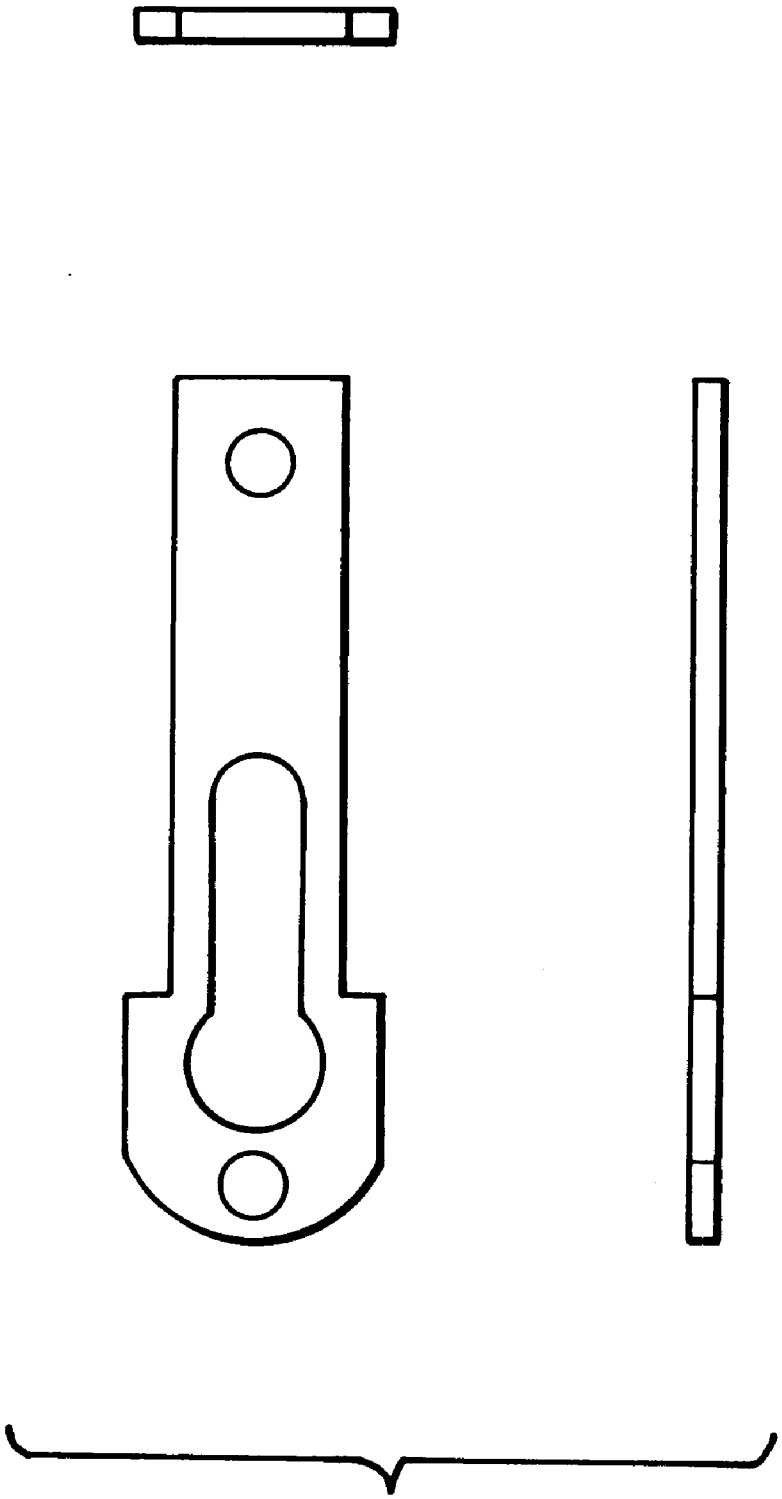
Figure 7E:
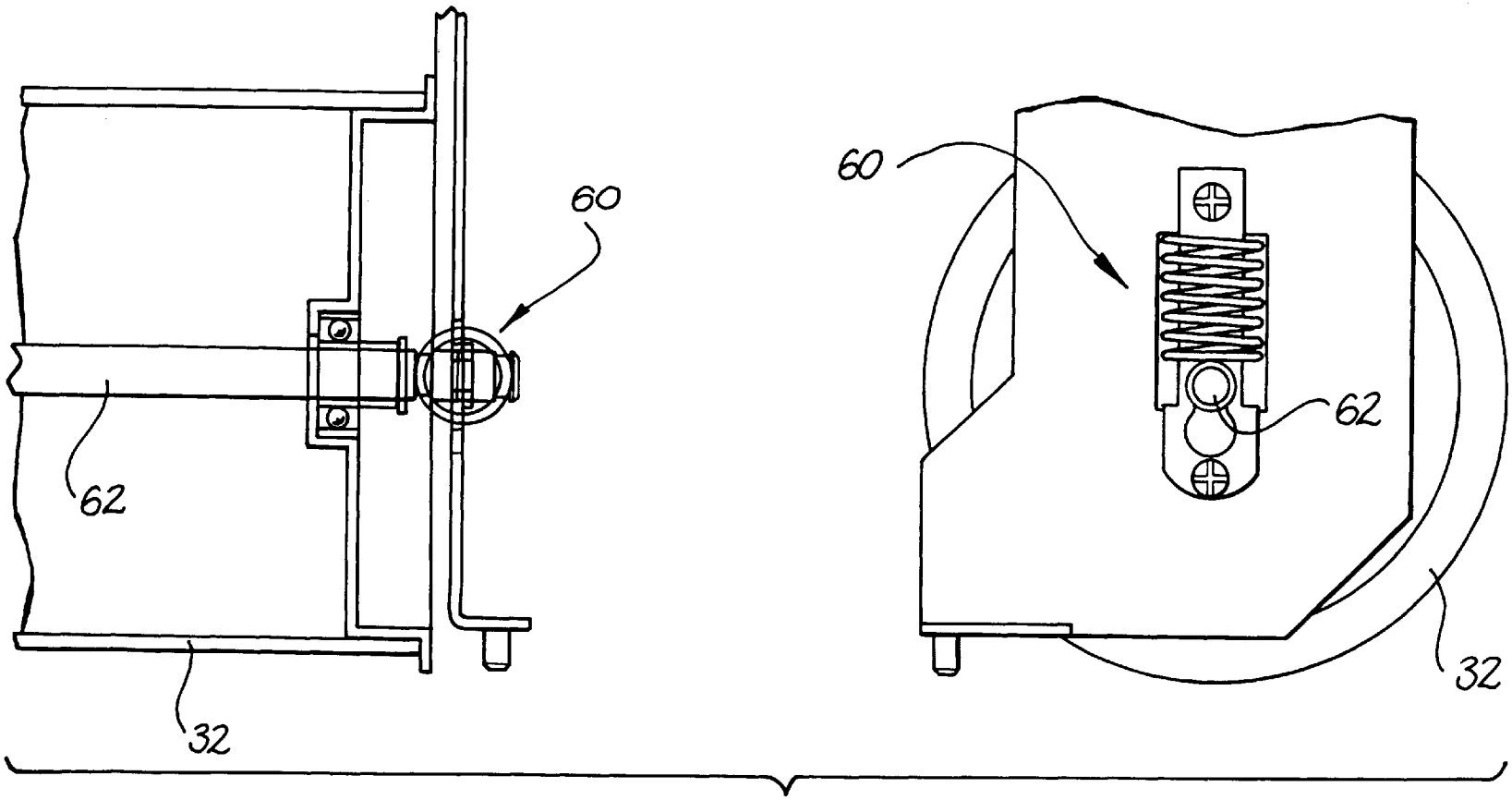

The device of this embodiment is shown in its assembled format, in FIG. 6, whilst various components of the device are detailed in FIG. 7. The main additional components provided in the present invention are the incorporation of biasing means 60 on at least one end of at least one of the axles of the rollers, whilst, a displacement means 61 may be provided on the same or another axle of a roller. In the embodiment described, a spring is provided to bias axle 62 of roller 32, whilst a slot 63, which is substantially J-shaped is provided to cooperate with axle 64 of roller 31 between the two positions. The slots 63 and roller 31 may be keyed together such that, after removing plate 36, the roller 31 is easily moved between the operational and disassembly positions. Roller 31 is able to be easily removed from the assembly. The embodiment of the invention also shows how side plate 65 is constructed with a separate upper end plate 66 and a lower end plate 67, attached to a main body portions in it's assembled position. Each of the end plates 66 and 67 are removable for installing/removing the carrier from about the rollers.

FIG. 6 shows how the side plate configuration need only be provided on one side of the display device. It will be understood by persons skilled in the art that providing such an arrangement on only one side will be sufficient to effect the required functions. Of course, there is no disadvantage to providing it on both sides of the device.

It will therefore be appreciated that by the provision of the biasing means 60, in this case embodied as a spring, the axle 62 is biased in the direction of arrow 68, that is, the roller 32 is biased outwardly or away from roller 31, consequently retaining the carrier 33 in a tensioned state. It will be appreciated that if the carrier 33 is of varying thickness, perhaps due to the provision of translites or slats at certain positions thereon and due to the means for attaching the translites to the carrier (such as by using VELCRO), the biasing means 60 will allow certain movement of the axle 62 in the directions of arrow 69. This is effectively acts as a 'shock absorber' to achieve a smoother operation of movement. Furthermore, the provision of the spring mechanism assists to relieve the stresses which may otherwise be placed on transparencies and fixings, to consequently assist in longevity of useful life of the transparencies.

In order to remove or replace the carrier 33 from the display device, the end plates 66 and 67 may firstly be removed. Once removed, the axle 64 may be moved to the other end 70 of the J-slot 63 such that it is more proximal to axle 62. That is, a portion of the tension of biasing means 60 may be released, such that the carrier 33 is slackened, and permitted to be easily slid over the rollers (in the axial direction). It will be appreciated, therefore, that the present invention has a number of advantages over earlier known display devices in that such a precise manufacture of the carrier and of the rollers is no longer required, whilst the appropriate tension is still achieved. Other advantages include the allowance for any stretch of carrier 33 and the smoother operation to accommodate the varying thicknesses of carrier 33 as well as variances in roller tolerance.

It will be appreciated that numerous variations and modifications may be envisaged to the present invention. It will be appreciated that only one biasing means needs to be provided on at least one end of one roller, regardless as to the number of rollers that might be utilised. It will also be appreciated that the biasing means and the displacement axle may be embodied on at least one end of only one roller, rather than on two separate rollers. It will also be appreciated that any number of rollers may be provided.

These and all other variations and modifications which become apparent to persons skilled in the art should however be considered to fall within the scope of the invention as broadly hereinbefore described and as claimed hereinafter.

What is claimed is:

1. A display device, including:

at least two rotatable roller members located in substantially parallel spaced apart relationship;

a carrier means, embodied as a belt or band, and formed of lightweight plastic material, being tightly supported by and rotatable about at least two of said roller members in a spool-like manner, said carrier means constructed to receive at least one display means thereon, each of said carrier means and said display means being constructed at least partially of substantially flexible and translucent material;

said display means each embodied as at least one of translite(s) and slat(s) sized and shaped to fit between a pair of adjacent rollers such that at least one discrete rest position(s) is automatically identified after said display device is rotated, due to alteration in thickness of the belt formed by the carrier and the translite(s) and/or slat(s), whereby, in said rest position(s), one of said display means is centrally positioned between a respective pair of rollers; and, illumination means, provided behind at least a portion of said carrier means, to illuminate a viewing portion of said carrier means and said display means thereon, wherein said display device is biased into its discrete rest position(s) due to alteration in thickness of the belt formed by the carrier and the translite(s) and/or slat(s).

2. A display device as claimed in claim 1, wherein, due to increased thickness of the belt in the regions whereat the translates are affixed, the carrier identifies at least one rest position where the translite(s) are displayed in the regions intermediate the rollers.

3. A display device as claimed in claim 1, wherein, at least one cutout is provided in the belt, such that the portion of the belt with a cutout finds a rest position about the roller surface.

4. A display device as claimed in claim 1, wherein at least one alignment tab is provided on the rear surface of the carrier to identify a rest position of the carrier about the rollers.

5. A display device as claimed in claim 1, wherein said translite(s) is/are attached to said carrier by a substantially transparent/translucent adhesive material.

6. A display device as claimed in claim 1, wherein said translite(s) is/are attached to said carrier by a covering sheet provided over substantially the entirety of said carrier, such that each translite is positioned between said carrier and said covering sheet.

7. A display device as claimed in claim 1, wherein said translite(s) is/are attached to said carrier by a hook and loop fastening system.

8. A display device as claimed in claim 1, wherein each slate may optionally be provided with at least one window portion therein, and wherein an indicia module may be provided behind said window.

9. A display device as claimed in claim 1, wherein each said carrier means has a lip thereon to support an edge of a respective slat.

10. A display device as claimed in claim 1, wherein each slat may optionally be provided with at least one window portion therein, and wherein an indicia module may be provided behind said window.

11. A display device as claimed in claim 1, wherein each indicia module includes:

at least one substantially translucent carrier to removably house an indicia card;

at least one attachment means to attach said indicia module to said carrier means.

12. A display device as claimed in claim 1, wherein said attachment means includes at least one protrusion on the edge of each module, adapted to be retained by said carrier means.

13. A display device as claimed in claim 1, wherein the display device further includes drive means, to drive at least one of said roller members and to thereby selectively move at least one display means between a viewing position and a storage position(s).

14. A display device as claimed in claim 1, wherein said drive means continuously move said carrier means.

15. A display device as claimed in claim 1, wherein said drive means is operated intermittently, to move one of at least two display means to said viewing position, one at a time.

16. A display device as claimed in claim 1, wherein said indicia module for use with a display device having slat carriers, includes:

a module frame, sized and shaped to fit between a pair of slat carriers; and display window means intermediate said module frame, for selectively and removably inserting display indicia therein;

characterized in that said module is provided with at least one protrusion forming an attachment means such that resistance to sliding of said module along said slat carrier is effected.

17. A display device as claimed in claim 1, wherein the plastic material is polycarbonate.

18. A display device including:

a carrier, embodied as a belt or band, and formed of lightweight plastic material, being tightly supported by and rotatable about at least two of said roller members in a spool-like manner, said carrier constructed to receive at least one display means thereon, each of said carriers and said display means being constructed at least partially of substantially flexible and translucent material;

at least two rotatable rollers located in a substantially parallel spaced-apart relationship and adapted to receive the carrier thereabouts, at least one end of at least one of the rollers being supported on an axle which, in an assembled position, is biased to retain said carrier under tension, at least one of the rollers being supported by an axle in which at least one end thereof may be displaced between first and second positions, whereby in the first position said display device is ready for use, and, in the second position, said axle is displayed more proximal relative to the other roller(s) such that the carrier may be removed/installed from said rollers;

said display means each embodied as at least one of translite(s) and slat(s) sized and shaped to fit between a pair of adjacent rollers such that at least one discrete rest position(s) is automatically identified after said display device is rotated, whereby, in said rest position (s), one of said display means is centrally positioned between a respective pair of rollers; and illumination means, provided behind at least a portion of said carrier means to illuminate a viewing portion of said carrier means and said display means thereon.

19. A display device as claimed in claim 18, wherein said at least one end of at least one of the rollers is biased by means of a spring.

20. A display device as claimed in claim 18, wherein said axle is displaced by movement of said axle within a slot which is substantially J-shaped or inverted J-shaped.

21. A display device as claimed in claim 18, wherein at least one side plate supporting said rollers is formed such that, at least in said second position, said carrier may be slid over said side plate.

22. A display device as claimed in claim 18, wherein to facilitate removal/installation of said carrier from/onto said rollers, said at least one side plate is formed of removable and/or pivotal sections.

* * * * *